US009953570B2

(12) United States Patent
Nakatani

(10) Patent No.: US 9,953,570 B2
(45) Date of Patent: Apr. 24, 2018

(54) DISPLAY DEVICE

(71) Applicant: JOLED INC., Tokyo (JP)

(72) Inventor: Toshikuni Nakatani, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 15/116,316

(22) PCT Filed: Dec. 24, 2014

(86) PCT No.: PCT/JP2014/006420
§ 371 (c)(1),
(2) Date: Aug. 3, 2016

(87) PCT Pub. No.: WO2015/118601
PCT Pub. Date: Aug. 13, 2015

(65) Prior Publication Data

US 2017/0011684 A1 Jan. 12, 2017

(30) Foreign Application Priority Data

Feb. 5, 2014 (JP) ..... 2014-020645

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/2092* (2013.01); *G09G 3/3266* (2013.01);
(Continued)

(58) Field of Classification Search
CPC .. G09G 3/3233; G09G 3/2092; G09G 3/3266; G09G 3/3283; G09G 3/3696;
(Continued)

(56) References Cited

U.S. PATENT DOCUMENTS 6,509,062 B2 1/2003 Komiya
6,509,692 B2 * 1/2003 Komiya ..... G09G 3/3233 257/E27.111
(Continued)

FOREIGN PATENT DOCUMENTS

JP 09-050006 2/1997
JP 2002-040963 2/2002
(Continued)

OTHER PUBLICATIONS

International Search Report, dated Mar. 17, 2015 by the Japan Patent Office (JPO), in the corresponding International Application No. PCT/JP2014/006420.

*Primary Examiner* — Dmitriy Bolotin
(74) *Attorney, Agent, or Firm* — Greenblum & Bernstein, P.L.C.

(57) ABSTRACT

A display device is provided that includes a plurality of pixel circuits that are arranged in a matrix and supplied with power through a first power supply line maintained at a first voltage and a second power supply line maintained at a second voltage having a positive value less than the first voltage. The display device also includes a first power supply circuit of a synchronous rectification type that outputs the first voltage to the first power supply line by chopping an input voltage. The display device further includes a second power supply circuit of the synchronous rectification type that outputs the second voltage to the second power supply line by chopping the first voltage.

4 Claims, 7 Drawing Sheets

(51) Int. Cl.
*G09G 3/3266* (2016.01)
*G09G 3/3283* (2016.01)
*G09G 3/36* (2006.01)

(52) U.S. Cl.
CPC ..... *G09G 3/3283* (2013.01); *G09G 3/3696* (2013.01); *G09G 2300/0809* (2013.01); *G09G 2300/0814* (2013.01); *G09G 2300/0842* (2013.01); *G09G 2300/0866* (2013.01); *G09G 2310/08* (2013.01); *G09G 2320/0646* (2013.01); *G09G 2330/028* (2013.01)

(58) Field of Classification Search
CPC ... G09G 2300/0809; G09G 2300/0814; G09G 2300/0842; G09G 2300/0866; G09G 2310/08; G09G 2320/0646; G09G 2330/028
See application file for complete search history.

(56) References Cited

U.S. PATENT DOCUMENTS

| | | | | |
|---|---|---|---|---|
| 7,256,758 | B2 | 8/2007 | Hu et al. | |
| 8,743,029 | B2 | 6/2014 | Tanikame et al. | |
| 9,165,498 | B2 | 10/2015 | Kim | |
| 2002/0021096 | A1* | 2/2002 | Komiya | G09G 3/3233 315/169.1 |
| 2004/0239664 | A1* | 12/2004 | Hu | G09G 3/3208 345/211 |
| 2005/0083025 | A1* | 4/2005 | Brown | H02M 3/158 323/283 |
| 2009/0039843 | A1 | 2/2009 | Kudo | |
| 2009/0262102 | A1 | 10/2009 | Tanikame et al. | |
| 2010/0176782 | A1 | 7/2010 | Kudo | |
| 2011/0025671 | A1* | 2/2011 | Lee | G09G 3/003 345/211 |
| 2011/0204858 | A1 | 8/2011 | Kudo | |
| 2011/0310076 | A1 | 12/2011 | Kim | |
| 2012/0026155 | A1* | 2/2012 | Komiya | G09G 3/003 345/213 |
| 2012/0217942 | A1 | 8/2012 | Kudo | |
| 2013/0249883 | A1* | 9/2013 | Hwang | G09G 3/003 345/212 |
| 2014/0028270 | A1* | 1/2014 | Miyazaki | G05F 1/10 323/271 |
| 2014/0077790 | A1* | 3/2014 | Sohma | H02M 3/1588 323/313 |
| 2014/0292294 | A1* | 10/2014 | Kihara | H02M 1/14 323/282 |
| 2014/0320476 | A1* | 10/2014 | Choi | G09G 3/3258 345/212 |

FOREIGN PATENT DOCUMENTS

| | | |
|---|---|---|
| JP | 2004-343909 | 12/2004 |
| JP | 2004-361925 | 12/2004 |
| JP | 2007-325414 | 12/2007 |
| JP | 2008-310128 | 12/2008 |
| JP | 2009-044831 | 2/2009 |
| JP | 2012-003218 | 1/2012 |
| JP | 2012-143030 | 7/2012 |

* cited by examiner

DISPLAY DEVICE

TECHNICAL FIELD

The present disclosure relates to display devices, and particularly to a display device using a light-emitting element which emits light according to an electrical current.

BACKGROUND ART

A display device using an organic electroluminescent (EL) element is known as an example of a display device using a current-driven light-emitting element.

An organic EL display device using a self-luminous organic EL element does not require a backlight, which a liquid-crystal display device requires, and therefore is most suitable when a thinner display device is desired. Since there is no limit on a viewing angle of the organic EL display device, the organic EL device is expected to be put to practical use as a next-generation display device. The organic EL element used in the organic EL display device is different from a liquid-crystal cell in that luminance of each light-emitting element is controlled by a value of a current flowing therethrough whereas the liquid-crystal cell is controlled by a voltage applied thereto.

As just described, the organic EL display device, which is a device having almost the same structure as the liquid-crystal display device, can be provided as a ultra-thin, light-weight display for the above-mentioned reason that no backlights are necessary. In this case, structures other than an organic EL display panel need to be made thinner. The size of a power supply device, among the structures other than the organic EL display panel, depends on power consumption of the organic EL display panel, and therefore it is difficult to simply make the power supply device thinner.

For example, FIG. 1 of Patent Literature (PTL) 1 discloses, as a power supply in an organic light emitting diode (OLED) display, two power source circuits connected in parallel for an input voltage. Specifically, a +ELVDD power source circuit and a −ELVSS power source circuit are included as the two power source circuits. The +ELVDD power source circuit generates a +ELVDD voltage of a ELVDD power source which is supplied to a pixel (PX) of the OLED display. The −ELVSS power source circuit generates a −ELVSS voltage of a ELVSS power source which is supplied to a pixel (PX) of the OLED display.

CITATION LIST

Patent Literature

[PTL 1] Japanese Unexamined Patent Application Publication No. 2012-003218

SUMMARY OF INVENTION

Technical Problem

There is, however, a problem in the above-described related art in that since the two power source circuits are connected in parallel for an input voltage, in the case where an output voltage is a few tenths of an input voltage in one of the power source circuits, switching loss occurs due to an ultra-short pulse behavior, and thus it is difficult to improve the power supply efficiency. Furthermore, in the case where the power source circuits include transformers, there is a problem that such power source circuits have increased weight and size, and thus it is difficult to make the display device thinner and lighter.

The present disclosure aims to provide a display device including a power supply that has improved power supply efficiency and is suitable for making the display device thinner and lighter.

Solution to Problem

In order to achieve the above object, the display device according to the present disclosure includes: a plurality of pixel circuits that are arranged in a matrix and driven by a first voltage and a second voltage having a positive value less than the first voltage; a first power supply circuit of a synchronous rectification type that outputs the first voltage to a first power supply line by chopping an input voltage; and a second power supply circuit of the synchronous rectification type that outputs the second voltage to the second power supply line by chopping the first voltage. The first power supply circuit includes: a first high-side switch and a first low-side switch connected in series between a grounding line and an input power supply line to which the input voltage is applied; a first inductor having one end connected to a connection point between the first high-side switch and the first low-side switch, and an other end connected to the first power supply line; and a first controller that controls turning ON and OFF of the first high-side switch and the first low-side switch. The second power supply circuit includes: a second high-side switch and a second low-side switch connected in series between the first power supply line and the grounding line; a second inductor having one end connected to a connection point between the second high-side switch and the second low-side switch, and an other end connected to the second power supply line; and a second controller that controls turning ON and OFF of the second high-side switch and the second low-side switch.

Advantageous Effects of Invention

The display device according to the present disclosure can have improved power supply efficiency and be made thinner and lighter.

DESCRIPTION OF EMBODIMENTS (Underlying Knowledge Forming Basis of the Present Invention)

Figure 2:
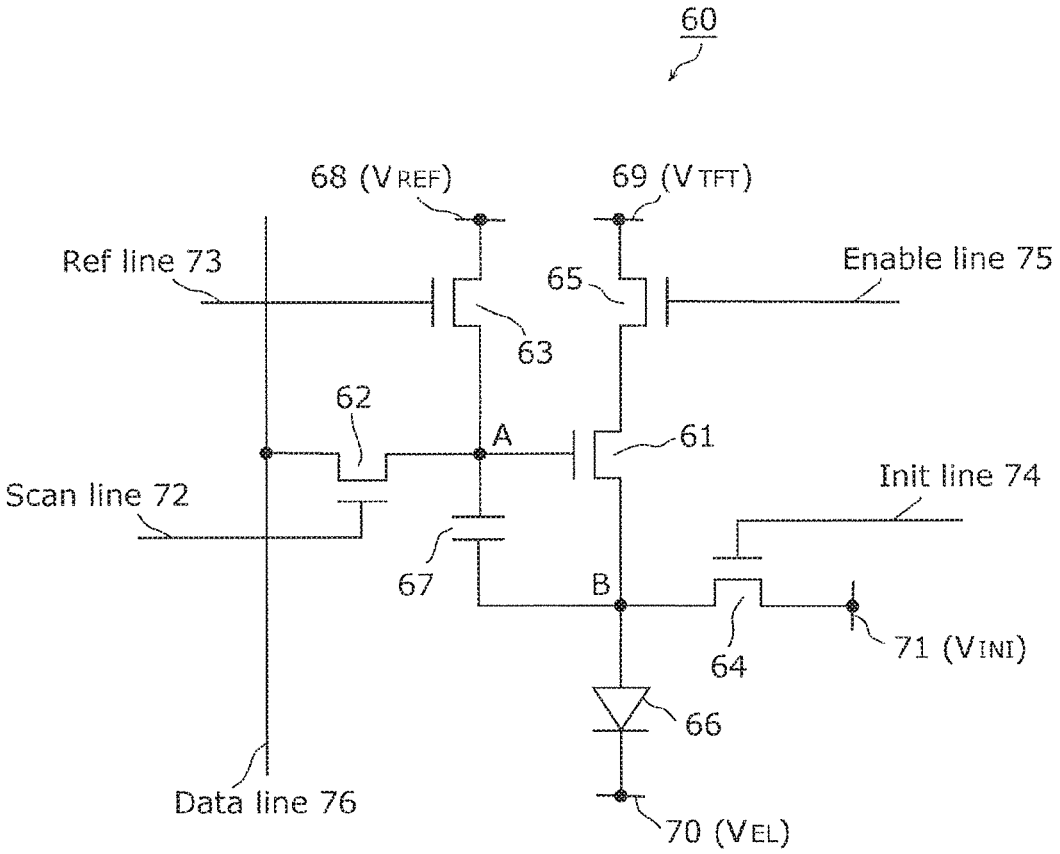
FIG. 2 is a circuit diagram illustrating an example of a configuration of a pixel circuit according to an embodiment.

The inventor has found that in a pixel circuit such as that illustrated in FIG. 2, for example, a power supply on the low voltage side which supplies power to the pixel circuit should have neither a voltage of 0 V nor a negative voltage, but a positive voltage (e.g., approximately 2 V to 3 V).

First, knowledge obtained by the inventor and the background of this point are described using the example of the pixel circuit illustrated in FIG. 2.

FIG. 2 is a circuit diagram illustrating an example of a configuration of a pixel circuit used in an organic EL display device.

A pixel circuit 60 in FIG. 2 includes a light-emitting element 66, a driving transistor 61, a capacitance element 67, and a switching transistor 62 as basic elements.

The light-emitting element 66 is, for example, an organic EL light-emitting element, and emits light at a brightness that corresponds to an amount of current supplied thereto.

The driving transistor 61 is supplied with a voltage $V_{TFT}$ of a first power supply line 69 via a switching transistor 65, and supplies a current corresponding to a gate-to-source voltage thereof to the light-emitting element 66.

The capacitance element 67 applies a voltage representing a brightness (i.e., a luminance voltage) between the gate and the source of the driving transistor 61.

The switching transistor 62 is a switch for writing the luminance voltage from a Data line 76 into the capacitance element 67.

Furthermore, the pixel circuit 60 includes switching transistors 63, 64, and 65 as additional elements. The additional elements mean that the switching transistors 63, 64, and 65 are provided for enabling an operation of compensating for variations in the threshold voltages of the driving transistors 61 in the pixel circuits. A typical example of the driving transistor 61 is a thin film transistor (TFT). It is known that there is a shift in a threshold voltage $V_t$ of the driving transistor 61 due to a change with time depending on the rate of use thereof. The switching transistors 63, 64, and 65 are included as elements that enable a threshold voltage compensation operation.

Next, the threshold voltage compensation operation is briefly described. The threshold voltage compensation operation is an operation of causing the capacitance element 67 to hold a voltage substantially equal to an actual threshold voltage of the driving transistor 61 immediately before the luminance voltage is written by the switching transistor 62 into the capacitance element 67. When the luminance voltage is applied to the capacitance element 67 through the switching transistor 62 immediately after this threshold voltage compensation operation, the capacitance element 67 holds a voltage substantially equal to the sum of the actual threshold voltage of the driving transistor 61 and the luminance voltage. With this, when the luminance voltage is 0 V, for example, the pixel circuit 60 is a black pixel (that is, the light-emitting element 66 does not emit light), and therefore the effect of variations in the threshold voltage can be inhibited. Thus, quality deterioration due to variations in the threshold voltage between the pixel circuits can be inhibited.

Next, a power supply on the low voltage side in a pixel circuit such as that described above ($V_{EL}$ in FIG. 2) is described.

If the power supply $V_{EL}$ in the pixel circuit 60 has a voltage of 0 V, the following troubles can occur. That is, when the driving transistor 61 is of the n-channel type, and there are large variations in threshold voltage $V_t$ between the pixel circuits (for example, the threshold voltage $V_t$ varies between about 1.5 V and 5 V), (1) there are cases where the above-described threshold voltage compensation operation is incomplete; As a result, (2) even when 0 V representing no light emission, i.e., black, is written into the capacitance element 67 as the luminance voltage, it is inevitable that the pixel circuit 60 becomes slightly luminous; and (3) the effective range of the voltage which can be held in the capacitance element 67 is narrow. These troubles can occur.

The inventor has found that these troubles can be solved by setting the power supply voltage $V_{EL}$ of the pixel circuit 60 to neither 0 V nor a negative voltage, but to a positive voltage (e.g., 2 V to 3 V).

Therefore, a power supply device that supplies power to the pixel circuit 60 needs to generate two different power supply voltages, a power supply $V_{TFT}$ (e.g., more than 20 V and less than 30 V) and a power supply $V_{EL}$ (e.g., 2 V to 3 V).

In the related art, as described above, there is a problem with two power source circuits connected in parallel for an input voltage in that in the case where an output voltage is a few tenths of an input voltage in one of the power source circuits, switching loss occurs due to an ultra-short pulse behavior, and thus it is difficult to improve the power supply efficiency. Furthermore, in the case where the power source circuits include transformers, there is a problem that such power source circuits have increased weight and size, and thus it is difficult to make the display device thinner and lighter.

In addition, in the case where one of two power source circuits connected in parallel for an input voltage generates a power supply voltage of approximately 2 V to 3 V on the low voltage side, the duty cycle of ON periods in a switching operation is short even when a switching power supply is used. For example, when the input voltage is approximately 30 V, setting the output voltage to 2 V to 3 V results in the above-noted duty cycle being extremely short, causing another problem that it is difficult to stabilize the output voltage.

The present disclosure aims to provide a display device including a power supply that has improved power supply efficiency and is suitable for making the display device thinner and lighter.

Embodiment

Hereinafter, an embodiment will be described in detail with reference to the Drawings where necessary. Note, however, that detailed descriptions may be omitted where unnecessary. For example, detailed descriptions of well-known aspects or repetitive descriptions of essentially similar configurations may be omitted. This is to avoid redundancy and make the following description easier for those skilled in the art to understand.

Note that the inventor provides the accompanying Drawings and the following description not to limit the scope of the claims, but to aid those skilled in the art to adequately understand the present disclosure.

Hereinafter, a display device according to the embodiment will be described with reference to FIG. 1 to FIG. 4A and FIG. 4B.

1. Configuration of Display Device

Figure 1:
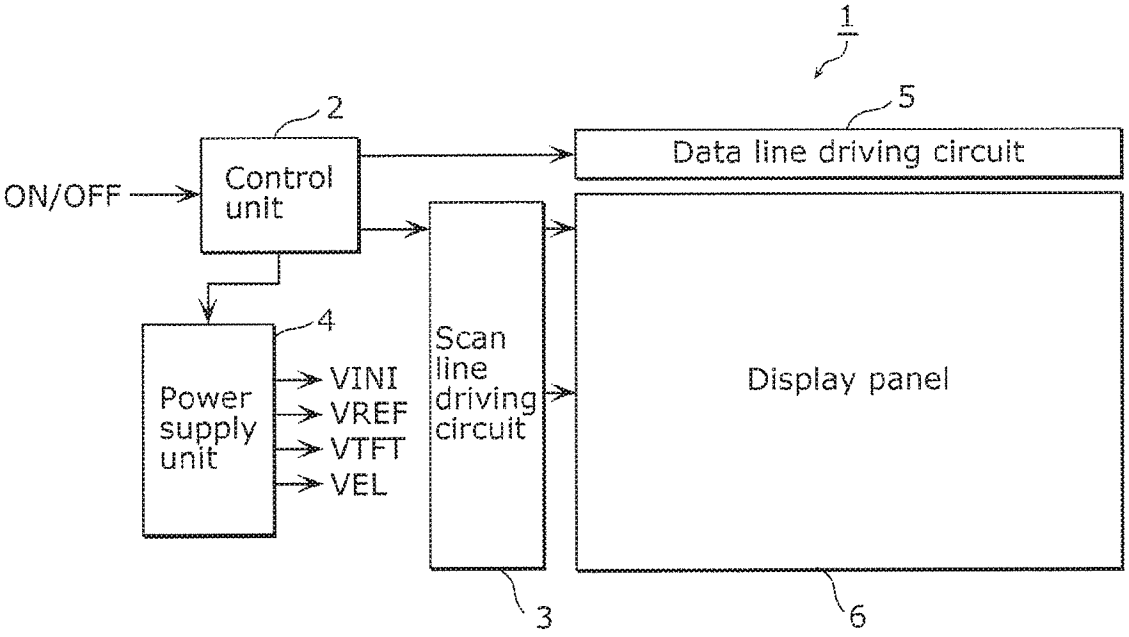
FIG. 1 is a block diagram illustrating an example of a configuration of a display device according to an embodiment.

FIG. 1 is a block diagram illustrating an example of a configuration of a display device according to an embodiment. FIG. 2 is a circuit diagram illustrating an example of a configuration of a pixel circuit according to an embodiment.

A display device 1 in FIG. 1 is an example of an organic EL display device, and includes a control unit 2, a scan line driving circuit 3, a power supply unit 4, a data line driving circuit 5, and a display panel 6.

The display panel 6 is, for example, an organic EL display panel, and includes a plurality of pixel circuits arranged in a matrix. Each of the plurality of pixel circuits is driven by a first voltage $V_{TFT}$ and a second voltage $V_{EL}$ having a positive value less than the first voltage $V_{TFT}$, and has a function of emitting light corresponding in amount to a luminance voltage supplied from the data line driving circuit 5.

Next, an example of the configuration of the pixel circuit in FIG. 2 will be described.

1-1. Configuration of Pixel Circuit

A pixel circuit 60 in FIG. 2 includes the driving transistor 61, the switching transistors 62 to 65, the light-emitting element 66, and the capacitance element 67. The Data line 76 is a data line for supplying the luminance voltage from the data line driving circuit 5. A reference voltage power supply line 68 is a power supply line for supplying a reference voltage $V_{REF}$ from the power supply unit 4. The reference voltage $V_{REF}$ is set in an initialization period as a potential of a first electrode of the capacitance element 67. The initialization period will be described later. The first power supply line 69 is a power supply line for supplying the first voltage $V_{TFT}$ from the power supply unit 4. A second power supply line 70 is a power supply line for supplying the second voltage $V_{EL}$ from the power supply unit 4. An initialization power supply line 71 is a power supply line for supplying an initialization voltage $V_{INI}$. The second electrode of the capacitance element 67 is set to the initialization voltage $V_{INI}$ in the initialization period.

The light-emitting element 66 is, for example, an organic EL element, and emits light corresponding in amount to an amount of current supplied from the driving transistor 61. The light-emitting element 66 has a cathode connected to the second power supply line 70 and an anode connected to the source of the driving transistor 61. The voltage supplied to the second power supply line 70 is denoted by $V_{EL}$, and is, for example, 2 V to 3 V.

The driving transistor 61 is a voltage-driven driving transistor that controls an amount of current that is supplied to the light-emitting element 66, and allows a current to flow to the light-emitting element 66, thereby causing the light-emitting element 66 to emit light. Specifically, the driving transistor 61 has a gate connected to the first electrode of the capacitance element 67 and a source connected to the second electrode of the capacitance element 67 and the anode of the light-emitting element 66.

The driving transistor 61 causes the light-emitting element 66 to emit light, by allowing a drive current, which is a current corresponding to the luminance voltage, to flow to the light-emitting element 66 when there is no conduction between the reference voltage power supply line 68 and the first electrode of the capacitance element 67 with the switching transistor 63 placed in an OFF state, and there is conduction between the first power supply line 69 and the drain electrode of the driving transistor 61 with the switching transistor 65 placed in an ON state. The voltage supplied to the first power supply line 69 is denoted by $V_{TFT}$, and is, for example, 20 V. With this, the driving transistor 61 converts the luminance voltage applied between the gate and source thereof into a current corresponding to the luminance voltage, and supplies the current to the light-emitting element 66.

Furthermore, there are cases where the threshold voltage of the driving transistor 61 varies between the pixel circuits due to a shift in the threshold voltage with time. The effect of such variations can be inhibited by the threshold voltage compensation operation. In short, this threshold voltage compensation operation and the threshold setting operation are an operation of setting the voltage of the capacitance element 67 in each pixel circuit to a value equivalent to the threshold voltage of the corresponding driving transistor 61. Detailed descriptions of this operation will be given later.

The capacitance element 67 holds the luminance voltage, based on which the amount of a current allowed to flow through the driving transistor 61 is determined. Specifically, the second electrode of the capacitance element 67 (the electrode thereof on the node B side) is connected to the source of the driving transistor 61 and the anode of the light-emitting element 66. Furthermore, the second electrode of the capacitance element 67 is connected to the initialization power supply line 71 via the switching transistor 64. The first electrode of the capacitance element 67 (the electrode thereof on the node A side) is connected to the gate of the driving transistor 61. Furthermore, the first electrode of the capacitance element 67 is connected to the reference voltage power supply line 68 ($V_{REF}$) via the switching transistor 63.

The switching transistor 62 switches between conduction and non-conduction between the first electrode of the capacitance element 67 and the Data line 76 for supplying the luminance voltage. Specifically, the switching transistor 62 has a drain and a source, one of which is connected to the Data line 76 and the other of which is connected to the first electrode of the capacitance element 67, and has a gate connected to a Scan line 72. In other words, the switching transistor 62 has a function of writing, into the capacitance element 67, the luminance voltage corresponding to a video signal voltage (a video signal) supplied through the Data line 76.

The switching transistor 63 switches between conduction and non-conduction between the first electrode of the capacitance element 67 and the reference voltage power supply line 68 for supplying the reference voltage $V_{REF}$. Specifically, the switching transistor 63 has a drain and a source, one of which is connected to the reference voltage power supply line 68 and the other of which is connected to the first electrode of the capacitance element 67, and has a gate connected to a Ref line 73. In other words, the switching transistor 63 has a function of providing the reference voltage $V_{REF}$ to the first electrode of the capacitance element 67.

The switching transistor 64 switches between conduction and non-conduction between the second electrode of the capacitance element 67 and the initialization power supply line 71. Specifically, the switching transistor 64 has a drain and a source, one of which is connected to the initialization power supply line 71 and the other of which is connected to the second electrode of the capacitance element 67, and has a gate connected to an Init line 74. In other words, the switching transistor 64 has a function of providing the initialization voltage $V_{INI}$ to the second electrode of the capacitance element 67.

The switching transistor 65 switches between conduction and non-conduction between the drain electrode of the driving transistor 61 and the first power supply line 69. Specifically, the switching transistor 65 has a drain and a source, one of which is connected to the first power supply line 69 and the other of which is connected to the drain electrode of the driving transistor 61, and has a gate connected to a Enable line 75.

The pixel circuit 60 is configured as described above.

Note that the switching transistors 62 to 65 included in the pixel circuit 60 are assumed to be n-type TFTs in the following description, but are not limited to n-type TFTs. The switching transistors 62 to 65 may be p-type TFTs. N-type TFTs and p-type TFTs may be used in combination as the switching transistors 62 to 65. Note that the potential described below will be reversed for a signal line connected to the gate of the p-type TFT.

The potential difference between the reference voltage $V_{REF}$ of the reference voltage power supply line 68 and the initialization voltage $V_{INI}$ of the initialization power supply line 71 is set to a voltage greater than the maximum threshold voltage of the driving transistor 61.

The reference voltage $V_{REF}$ of the reference voltage power supply line 68 and the initialization voltage $V_{INI}$ of the initialization power supply line 71 are set as follows so that no current flows to the light-emitting element 66.

The initialization voltage $V_{INI}$<the reference voltage $V_{EL}$+(the forward current threshold voltage of the light-emitting element 66), (the reference Voltage $V_{REF}$ of the reference voltage power supply line 68)<the second Voltage $V_{EL}$+(the forward current threshold voltage of the light-emitting element 66)+(the threshold voltage of the driving transistor 61)

The second voltage $V_{EL}$ is a voltage of the second power supply line 70 as mentioned above. In order to meet these conditions, it is desirable that the second voltage $V_{EL}$ be a positive value of approximately 2 V to 3 V.

The pixel circuit 60 is configured as described above. Subsequently, the configuration in FIG. 1 will be described.

The control unit 2 in FIG. 1 controls the entire display device 1. Specifically, the control unit 2 controls a per-frame display operation based on a video signal representing an image to be displayed.

The scan line driving circuit 3 is controlled by the control unit 2 to drive and scan gate signals for the pixel circuits of the display panel 6. In the pixel circuit 60 in FIG. 2, these gate signals are four different signals, namely, a Scan signal, a Ref signal, an Enable signal, and an Init signal. More specifically, the scan line driving circuit 3 scans the Scan signal, the Ref signal, Enable signal, and Init signal in units of rows of the pixel circuits on the basis of a vertical synchronization signal and a horizontal synchronization signal which are included in the video signal representing an image to be displayed. These Scan signal, Ref signal, Enable signal, and Init signal are output to the Scan line 72, the Ref line 73, the Enable line 75, and the Init line 74, respectively, and are used for controlling switching ON and OFF of elements connected thereto in the example of the pixel circuit illustrated in FIG.

The power supply unit 4 supplies power to each unit of the control unit 2, the scan line driving circuit 3, and the display panel 6, and supplies various voltages to the display panel 6. In the example of the pixel circuit illustrated in FIG. 2, these various voltages are the first voltage $V_{TFT}$, the second voltage $V_{EL}$, the initialization voltage $V_{INI}$, and the reference voltage $V_{REF}$, and are supplied to each pixel circuit 60 through the initialization power supply line 71, the reference voltage power supply line 68, the first power supply line 69, and the second power supply line 70. The second voltage is not 0 V, but 2 V to 3 V as described above, and is generated by the power supply unit 4.

The data line driving circuit 5 is controlled by the control unit 2 to output the luminance voltage to the Data line 76 of the display panel 6 as a source signal. More specifically, the data line driving circuit 5 outputs a source signal to each pixel circuit based on the video signal and the horizontal synchronization signal.

The display device 1 is configured as described above.

1-2. Configuration of Power Supply Unit

Figure 3:
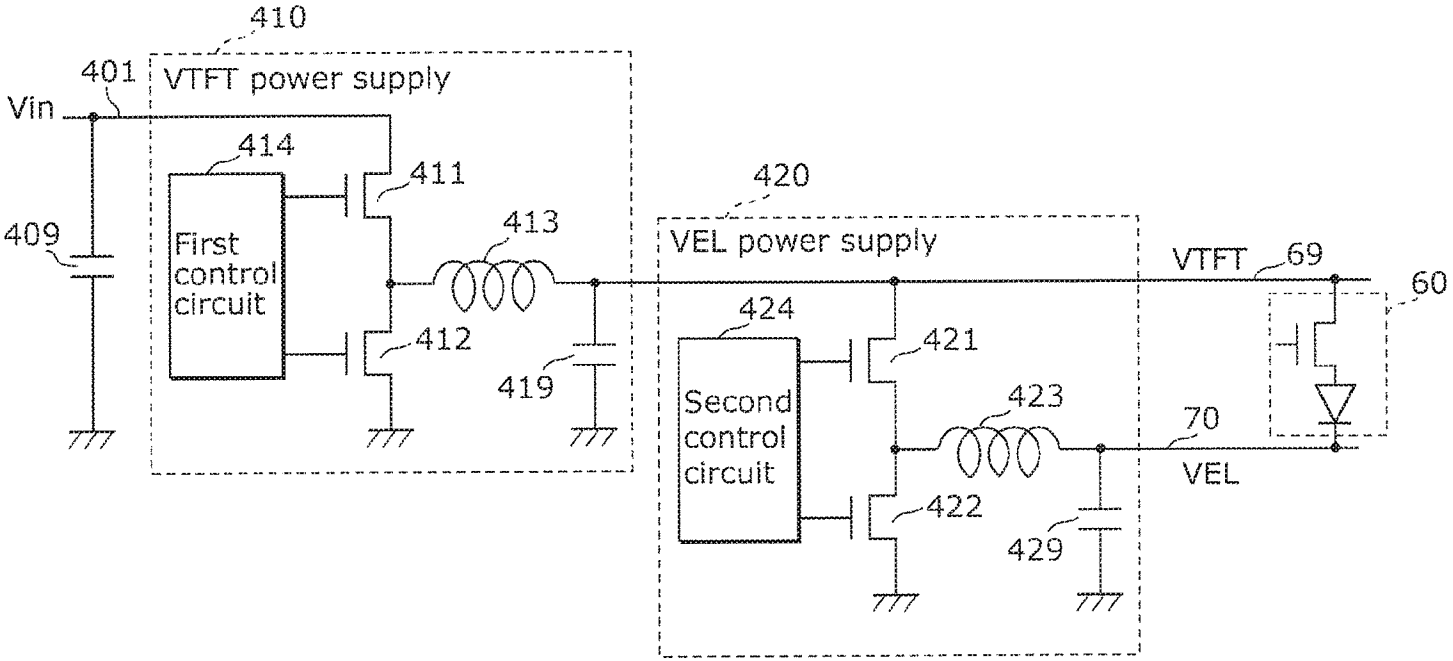
FIG. 3 is a circuit diagram illustrating an example of a configuration of a part of a power supply unit according to an embodiment.

Next, the configuration of the power supply unit 4 is described. FIG. 3 is a circuit diagram illustrating a circuit example of the power supply unit and the pixel circuit 60 according to the embodiment. This figure focuses on a part of the circuit configuration of the power supply unit 4 that generates the first voltage $V_{TFT}$ and the second voltage $V_{EL}$. In this figure, only one of the plurality of pixel circuits 50 is schematically illustrated as a representative.

The power supply unit 4 includes an input capacitor 409, a $V_{TFT}$ power supply 410, and a $V_{EL}$ power supply 420 as illustrated in FIG. 3. The $V_{TFT}$ power supply 410 is referred to also as a first power supply circuit, and the $V_{EL}$ power supply 420 is referred to also as a second power supply circuit.

An input voltage $V_{in}$ is a direct-current (DC) voltage of more than 30 V and less than 40 V supplied through the input power supply line 401.

The input capacitor 409 is a capacitance element that is connected between a grounding line and the input power supply line 401 located close to the input terminal of the $V_{TFT}$ power supply 410, and is used for stabilizing the input voltage $V_{in}$ and cutting down on noise.

1-2-1. Configuration of TFT Power Supply (First Power Supply Circuit)

The $V_{TFT}$ power supply 410 (i.e., the first power supply circuit) is a power supply circuit of a synchronous rectification type that outputs the first voltage $V_{TFT}$ to the first power supply line 69 by chopping the input voltage $V_{in}$. This $V_{TFT}$ power supply 410 includes a first high-side switch 411, a first low-side switch 412, a first inductor 413, a first control circuit 414, and a first output capacitor 419.

The first high-side switch 411 and the first low-side switch 412 are connected in series between the grounding line and the input power supply line 401 to which the input voltage $V_{in}$ is applied, and are each a power metal-oxide-semiconductor field-effect transistor (MOSFET), for example. The first control circuit 414 controls the first high-side switch 411 and the first low-side switch 412 so that the first high-side switch 411 and the first low-side switch 412 are exclusively turned ON.

The first inductor 413 is a coil having one end connected to a connection point between the first high-side switch 411 and the first low-side switch 412, and the other end connected to the first power supply line 69. When the first high-side switch 411 is ON and the first low-side switch 412 is OFF, the first inductor 413 stores electric energy from the input voltage $V_{in}$ applied to the one end thereof, and transfers the electric energy from the other end thereof to the first power supply line 69. Furthermore, the first inductor 413 releases the stored electric energy from the other end thereof to the first power supply line 69 when the first high-side switch 411 is OFF and the first low-side switch 412 is ON.

The first control circuit 414 controls turning ON and OFF of the first high-side switch 411 and the first low-side switch 412, and controls the duty cycle that is a percentage of a period in which the first high-side switch 411 is ON so as to set the first voltage $V_{TFT}$ of the first power supply line 69 to a desired voltage. The desired voltage for the first voltage $V_{TFT}$ is, for example, 20 V in the display device in FIG. 1.

The first high-side switch 411 and the first low-side switch 412 are controlled so as not to be ON at the same time.

The first output capacitor 419 is a capacitance element that is connected between the first power supply line 69 and the grounding line, and is used for smoothing a voltage generated with the electric energy released from the above-mentioned other end of the first inductor 413, as well as stabilizing the voltage and cutting down on noise. This first output capacitor 419 functions as an input capacitance element for the $V_{EL}$ power supply 420. Therefore, the $V_{EL}$ power supply 420 is not required to include a separate input capacitance element, and because the first output capacitor 419 has a reduced ripple current due to the later-described regeneration operation in the $V_{EL}$ power supply 420, a capacitor having a smaller capacitance can be used as the first output capacitor 419, meaning that the cost can be reduced.

1-2-2. Configuration of $V_{EL}$ Power Supply (Second Power Supply Circuit)

Instead of the above-stated input voltage $V_{in}$, the first voltage $V_{TFT}$ lower than the input voltage $V_{in}$ is input to the $V_{EL}$ power supply 420.

The $V_{EL}$ power supply 420 (i.e., the second power supply circuit) is a power supply circuit of a synchronous rectification type that outputs the second voltage $V_{EL}$ to the second power supply line 70 by chopping the first voltage $V_{TFT}$. As illustrated in FIG. 3, the $V_{EL}$ power supply 420 includes a second high-side switch 421, a second low-side switch 422, a second inductor 423, a second control circuit 424, and a second output capacitor 429.

The second high-side switch 421 and the second low-side switch 422 are connected in series between the grounding line and the first power supply line 69 to which the first voltage $V_{TFT}$ is applied, and are each a power MOSFET, for example. The second control circuit 424 controls the second high-side switch 421 and the second low-side switch 422 so that the second high-side switch 421 and the second low-side switch 422 are exclusively turned ON.

The second inductor 423 is a coil having one end connected to a connection point between the second high-side switch 421 and the second low-side switch 422, and the other end connected to the second power supply line 70. The second inductor 423 stores electric energy from the first voltage $V_{TFT}$ applied to the one end thereof when the second high-side switch 421 is ON and the second low-side switch 422 is OFF, and transfers the electric energy from the other end thereof to the second power supply line 70. Furthermore, the second inductor 423 releases the stored electric energy from the other end thereof to the second power supply line 70 when the second high-side switch 421 is OFF and the second low-side switch 422 is ON.

The second control circuit 424 controls turning ON and OFF of the second high-side switch 421 and the second low-side switch 422, and controls the duty cycle that is a percentage of a period in which the second high-side switch 421 is ON so as to set the second voltage $V_{EL}$ of the second power supply line 70 to a desired voltage. The desired voltage for the second voltage $V_{EL}$ is, for example, 2 V or 3 V in the display device in FIG. 1. Furthermore, the second control circuit 424 controls the second high-side switch 421 and the second low-side switch 422 so that the second high-side switch 421 and the second low-side switch 422 are not ON at the same time.

The second output capacitor 429 is a capacitance element that is connected between the second power supply line 70 and the grounding line, and is used for smoothing a voltage generated with the electric energy released from the above-mentioned other end of the second inductor 423, as well as stabilizing the voltage and cutting down on noise.

The $V_{TFT}$ power supply 410 and the $V_{EL}$ power supply 420 have the same configuration, but with a different circuit constant due to a difference in the output voltage.

Furthermore, in FIG. 3, a current flowing through the pixel circuit 60 is absorbed not by the grounding line, but by the second power supply line. In other words, a current flowing through the light-emitting element 66 in the plurality of pixel circuits 60 of the display panel 6 is absorbed by the second power supply line 70. Part of this current is stored into the second output capacitor 429 and the second inductor 423 via the second low-side switch 422 as electric energy and then is recycled, and another part of this current flows to the first power supply line 69 via the second inductor 423 and the second high-side switch 421 as a regenerative current. The power supply efficiency improves as a result of this recycling and this regenerative current.

The power supply unit 4 is configured as described above.

Note that specific values of the input voltage, the first voltage, and the second voltage should be determined according to the properties of the TFT, namely the driving transistor 61, (such as the threshold voltage of the driving transistor 61 and the magnitude of a threshold shift) and the properties of the light-emitting element 66 (such as a forward current threshold voltage). When the display device is an organic EL display device, for example, the input voltage, the first voltage, and the second voltage may be 30 V, 20 V, and 2V, respectively. As a more general standard, it is sufficient that the input voltage is more than 30 V and less than 40 V, the first voltage is in the range from 15 V to 25 V, and the second voltage is a positive voltage of 5 V or less.

2. Operation

Next, the operation of the power supply device illustrated in FIG. 3 and the operation of the display device illustrated in FIG. 1 will be described.

2-1. Operation of $V_{TFT}$ Power Supply (First Power Supply Circuit)

Figure 4A:
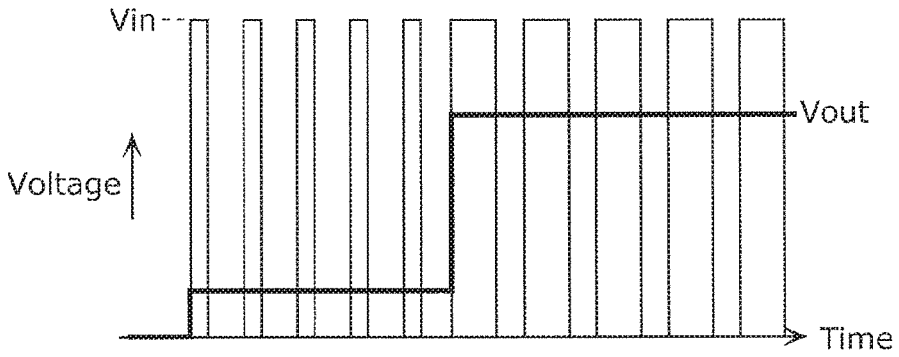
FIG. 4A illustrates the relationship between a chopping duty cycle and an output voltage of a $V_{TFT}$ power supply.

FIG. 4A illustrates the relationship between the switching duty cycle and the output voltage of the $V_{TFT}$ power supply 410. In FIG. 4A, the horizontal axis is a time axis, and the vertical axis represents voltage; the chopped input voltage (that is, a pulsed input voltage input to one end of the first inductor 413) and the output voltage, that is, the first voltage $V_{TFT}$, are schematically shown.

When the percentage of ON time of the first high-side switch 411 is 0, the output voltage $V_{out}$ is, of course, 0 V. The output voltage is low when the above percentage is low; as the above percentage increases, the output voltage increases.

As just described, in a power supply circuit with chopper control, such as the $V_{TFT}$ power supply 410, the percentage of ON time of the first high-side switch 411 is controlled according to the output voltage and the output current, so that the output thereof is stable even with varying loads. The input voltage $V_{in}$, the output voltage, i.e., the first voltage $V_{TFT}$, and a duty cycle $\alpha$ have the following relationship.

$$V_{TFT}=V_{in}\times\alpha$$

The duty cycle $\alpha$ is ON time/(ON time+OFF time) of the first high-side switch 411. When the input voltage is 30 V, the duty cycle $\alpha$ is set to 20/30, which is approximately 0.67, in order to obtain an output voltage of 20 V. In the case of pulse width modulation (PWM) control, the first control circuit 414 turns ON or OFF the first high-side switch 411 with this duty cycle at a frequency of more than 300 kHz and less than 400 kHz, for example.

2-2. Operation of $V_{EL}$ Power Supply (Second Power Supply Circuit)

The operation of the $V_{EL}$ power supply 420 is basically the same as that of the $V_{TFT}$ power supply 410; therefore, the following description will focus on the points of difference with the operation of the $V_{EL}$ power supply 420. In the $V_{EL}$ power supply 420, the input voltage, i.e., the first voltage $V_{TFT}$, the output voltage, i.e., the second voltage $V_{EL}$, and a duty cycle β have the following relationship.

$$V_{EL}=V_{TFT}\times\beta.$$

The duty cycle β is ON time/(ON time+OFF time) of the second high-side switch 421. When the input voltage, i.e., the first voltage, is 20 V, the duty cycle β is set to 2/20, which is 0.1, in order to obtain an output voltage of 2 V. In the case of PWM control, the second control circuit 424 turns ON or OFF the second high-side switch 421 with this duty cycle at a frequency of more than 100 kHz and less than 200 kHz, for example.

Figure 4B:
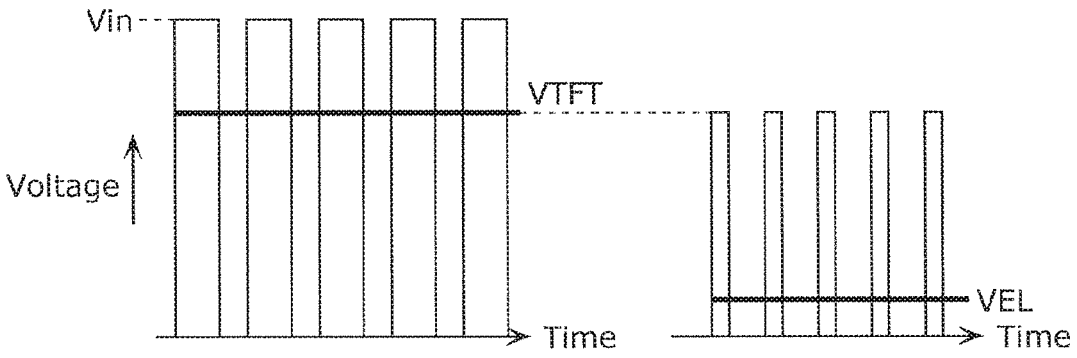
FIG. 4B is a time chart illustrating an example of operations of a $V_{TFT}$ power supply and a $V_{EL}$ power supply.

FIG. 46 is a time chart illustrating an example of operations of the $V_{TFT}$ power supply and the $V_{EL}$ power supply. The vertical and horizontal axes of FIG. 4B are the same as those in FIG. 4A. The left part of this figure shows a pulsed input voltage that is input to one end of the first inductor 413 in the $V_{TFT}$ power supply 410, and an output voltage, that is, the first voltage $V_{TFT}$. The right part of this figure shows a pulsed input voltage that is input to one end of the second inductor 423 in the $V_{EL}$ power supply 420, and an output voltage, that is, the second voltage $V_{EL}$.

As described above, the $V_{TFT}$ power supply 410 and the $V_{EL}$ power supply 420 in the power supply unit 4 are not connected in parallel for the input voltage $V_{in}$, and the first voltage $V_{TFT}$, which is lower than the input voltage $V_{in}$, is input to the $V_{EL}$ power supply 420. With this, the duty cycle is kept from being extremely small, and stabilization of the output voltage is facilitated.

Note that instead of the power MOSFET, a diode having an anode grounded is also usable as the first low-side switch 412 in the $V_{TFT}$ power supply 410. The diode, however, causes a loss due to a forward voltage drop, and therefore the power MOSFET is more advantageous than the diode from the perspective of improving the power supply efficiency. The second low-side switch 422 in the $V_{EL}$ power supply 420 cannot, in principle, be replaced with a diode because of the above-described regeneration (boosting) operation. On the other hand, even when the second high-side switch 421 is replaced with a diode, the regeneration is possible; however, the operation of the $V_{EL}$ power supply 420 including such a diode is insufficient because it is not possible to hold a voltage equivalent to the second voltage $V_{EL}$ if there is a period in which no current flows to the light-emitting element 66 (T26, T28 and T30 in FIG. 5). As a result, the second high-side switch 421 and the second low-side switch 422 cannot be replaced with a diode.

2-3. Display Operation

Next, the display operation of the display panel including the already mentioned threshold voltage compensation operation will be described.

Figure 5:
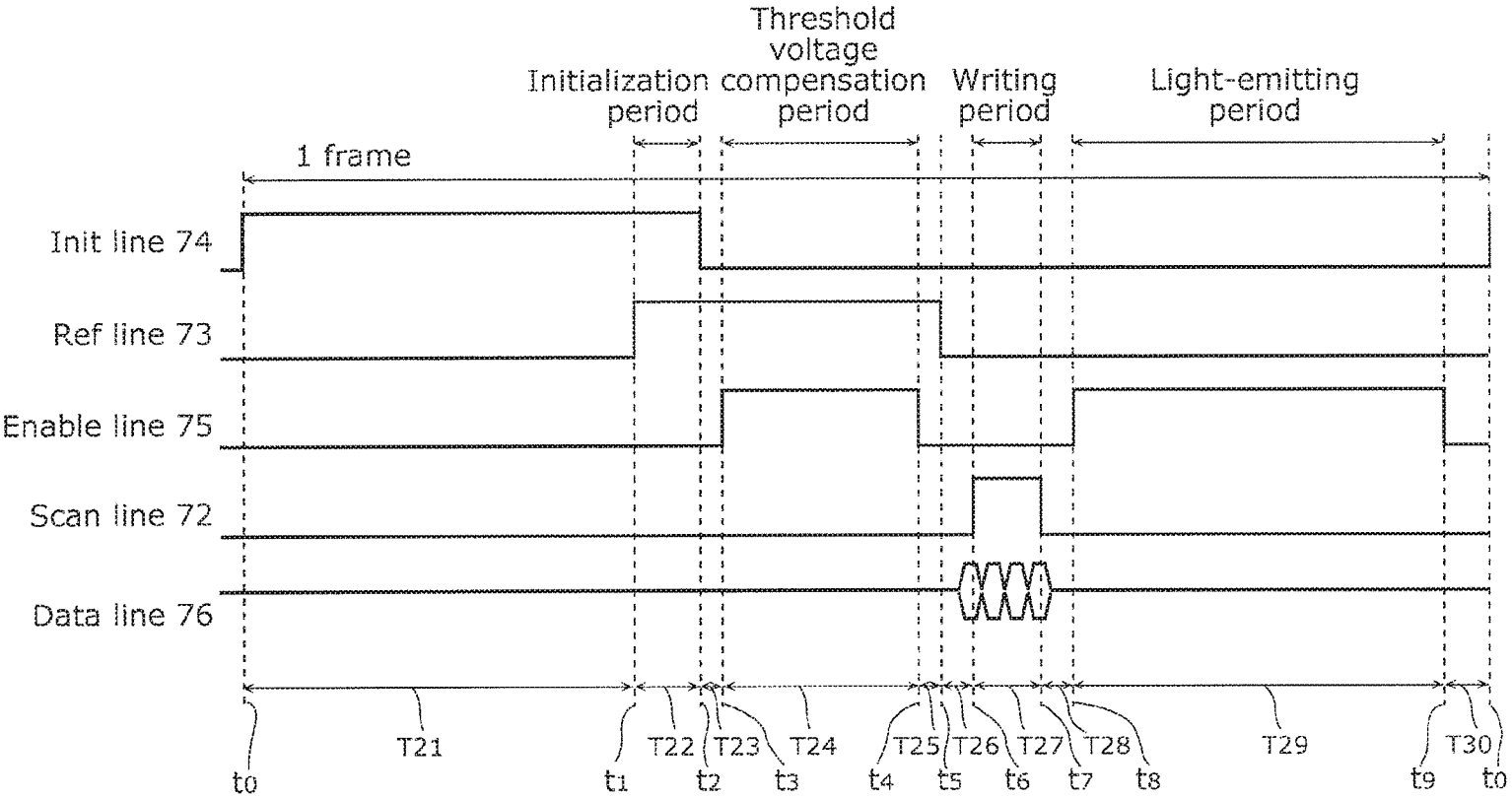
FIG. 5 is a time chart illustrating a detailed timing example of a display operation.

FIG. 5 is a time chart illustrating a detailed timing example of a display operation.

In this figure, the horizontal axis is a time axis, and the vertical axis represents control signals for the Init line 74, the Ref line 73, the Enable line 75, the Scan line 72, and the Data line 76 in the pixel circuit in FIG. 2. This figure shows a display operation performed in one frame. As shown in this figure, in each pixel circuit 60 at the end point of a period T25, a voltage equivalent to the threshold voltage of the driving transistor 61 is held in the capacitance element 67 as a result of the threshold voltage compensation operation in particular. With this, variations in the threshold voltage are compensated for. Detailed descriptions will be given below.

Period T21

In a period T21 from time t0 to time t1 in FIG. 5, only the switching transistor 64 is in a conducting state, and the potential at the node B in FIG. 2 is set to the initialization voltage $V_{INI}$ of the initialization power supply line 71.

The following will describe a reason for providing this period T21.

When the display panel 6, the pixel circuit 60, and the like in the display device 1 are large in size, the capacitance of the light-emitting element 66 is large, and the initialization power supply line 71 has a large wiring time constant, requiring time to set the voltage at the node B to the initialization voltage $V_{INI}$, of the initialization power supply line 71. Therefore, the period 121 in which the switching transistor 64 is placed in the conducting state first is provided so that the potential at the node B can be more reliably set to the initialization voltage $V_{INI}$ of the initialization power supply line 71.

Note that it also requires time to apply the reference voltage $V_{REF}$ of the reference voltage power supply line 68 to the node A. However, a subject that is charged and discharged with the reference voltage $V_{REF}$ is the capacitance element 67 and the reference voltage power supply line 68. In detail, although the reference voltage power supply line 68 and the initialization power supply line 71 have almost equal wiring time constants, the capacitance of the light-emitting element 66 is greater than the capacitance of the capacitance element 67, and the capacitance ratio of the light-emitting element 66 to the capacitance element 67, that is, (the capacitance of the light-emitting element 66)/(the capacitance of the capacitance element 67), is 1.3 to 1.9. Therefore, it requires a longer time to charge the light-emitting element 66 (i.e., to write the initialization voltage $V_{INI}$ of the initialization power supply line 71 into the potential at the node B) than to charge the capacitance element 67 (i.e., to write the reference voltage $V_{REF}$ of the reference voltage power supply line 68 into the potential at the node A).

Placing only the switching transistor 64 in the conducting state in the period T21 to delay in placing the switching transistor 63 in the conducting state produces the following advantageous effects.

That is, providing a period in which the initialization voltage $V_{INI}$ of the initialization power supply line 71 into the potential at the node B in the period T21 is advantageous in that the load of writing the initialization voltage $V_{INI}$ of the reference voltage power supply line 68 to the node A can be reduced. This means that providing the period T21 allows the node A to be set to a low voltage, resulting in that the reference voltage power supply line 68 only has to supply a current (a voltage) for charging the pixel circuit 60. In other words, since the reference voltage $V_{REF}$ of the reference voltage power supply line 68 is not used as a voltage for charging the light-emitting element 66, this is advantageous in that the load on the reference voltage power supply line 68 is reduced.

Thus, the period T21 in which the potential at the node B is set first is provided. With this, it is possible to shorten the total length of time of a period T22 subsequent to the period T21 while reducing the effect of power consumption of the display panel 6 and variations in luminance of the display panel 6.

Period T22: Initialization Period

The period T22 between time t1 to time t2 in FIG. 5 is an initialization period for causing the capacitance element 67 to hold an initial voltage necessary to pass a drain current for compensating for the threshold voltage of the driving transistor 61, and then applying the initialization voltage between the source and the gate of the driving transistor 61.

With this, the potential at the node A is set to the reference voltage $V_{REF}$ of the reference voltage power supply line 68. At this time, the potential at the node B has already been set to the initialization voltage $V_{INI}$ of the initialization power supply line 71. Specifically, the reference voltage $V_{REF}$ of the reference voltage power supply line 68 and the initialization voltage $V_{INI}$ of the initialization power supply line 71 are applied to the gate and the source of the driving transistor 61, respectively.

Note that the period T22 is set to such a length (of time) that the potentials at the node A and the note B are stabilized.

Furthermore, as described above, it is necessary that the voltage between the gate and the source of the driving transistor 61 is set to such an initial voltage that an initial drain current required to perform the threshold voltage compensation operation can be obtained. Specifically, at the capacitance element 67 of each of the plurality of pixel circuits 60, the initial voltage needs to be a voltage that is higher than the threshold voltage of the driving transistor 61 and does not cause the light-emitting element 66 to emit light. Therefore, the potential difference between the reference voltage $V_{REF}$ of the reference voltage power supply line 68 and the initialization voltage $V_{INI}$ of the initialization power supply line 71 is set to a voltage greater than the maximum threshold voltage of the driving transistor 61. Furthermore, the reference voltage $V_{REF}$ and the initialization voltage $V_{INI}$ are set so that no current flows to the light-emitting element 66 and so that the initialization voltage $V_{INI}$<(the second Voltage $V_{EL}$+the forward current threshold voltage of the light-emitting element 66), and $V_{REF}$<(the second voltage $V_{EL}$+the forward current threshold voltage of the light-emitting element 66+the threshold Voltage of the driving transistor 61).

From the perspective of satisfying these conditions, the second voltage $V_{EL}$ that is not 0 V, but 2 V to 3 V makes it easy to satisfy these conditions. The threshold voltage compensation operation allows the effect of a threshold shift of the driving transistor 61 to be reduced.

Period T23

A period T23 between t2 and t3 in FIG. 5 is for keeping the switching transistor 64 and the switching transistor 65 from being in the conducting state at the same time.

The period T23 in which the switching transistor 64 is in a non-conducting state with the operation of the Init line 74 is provided as described above, so that it is possible to prevent a through-current from flowing between the first power supply line 69 and the initialization power supply line 71 via the switching transistor 65, the driving transistor 51, and the switching transistor 64 by preventing the switching transistor 64 and the switching transistor 65 from being in the conducting state at the same time, which could occur without the period T23.

Period T24: Threshold Voltage Compensation Period

Next, a period T24 between time t3 and time t4 in FIG. 5 is a threshold voltage setting period for compensating for variations in the threshold voltage between the driving transistors 61 in the plurality of pixel circuits 60. In other words, the period T24 is a period in which, even when there are variations in the threshold voltages of the driving transistors 61 in the plurality of pixel circuits 60, a voltage equivalent to the threshold voltage of each of the driving transistors 61 is set for the corresponding capacitance element 67.

At time t3, the switching transistor 62 and the switching transistor 64 are placed in the non-conducting state (the OFF state), and the switching transistor 65 is placed in the conducting state (the ON state) while the switching transistor 63 is in the conducting state (the ON state). At this point in time, the voltage at the capacitance element 67 is the initial voltage set in the initialization period (the period T22) as described above, and thus no current flows to the light-emitting element 66. The driving transistor 61 is supplied with a drain current by the first voltage $V_{TFT}$ of the first power supply line 69, and the potential at the source of the driving transistor 61 changes accordingly. In other words, the potential at the source of the driving transistor 61 changes until the drain current that is supplied to the driving transistor 61 by the first voltage $V_{TFT}$ of the first power supply line 69 reaches 0. At the point in time when the drain current reaches 0, the voltage between the node A and the node B (that is, the voltage between the gate and the source of the driving transistor 61) is equivalent to an actual threshold voltage of the driving transistor 61. This voltage is held in the capacitance element 67.

At the end of the period T24 (time t4), the voltage equivalent to the actual threshold voltage of the driving transistor 61 is held in the capacitance element 67. With this, a voltage representing luminance that is written into the capacitance element 67 after a period T25 can be inhibited from deviating from a correct value by the threshold voltage shift, which is due to variations in the threshold voltage.

Period T25

The period T25 between time t4 and time t5 in FIG. 5 is for ending the threshold voltage compensation operation.

The period T25 in which the switching transistor 65 is in the non-conducting state with a signal from the Enable line 75 is provided between time t4 and time t5, so that the supply of a current from the first power supply line 69 to the node B via the driving transistor 61 can be stopped, and the threshold voltage compensation operation can be reliably ended before the next operation starts.

As described above, at time t5 when the period T25 is ended, the capacitance element 67 in each of the plurality of pixel circuits 60 holds a voltage equivalent to the actual threshold voltage of the corresponding driving transistor 61.

The above-described operations in the periods T21 to T25 are performed sequentially for each row in the display panel 6.

Period T26

A period T26 between time t5 and time t6 is a period in which the switching transistor 63 is placed in the non-conducting state (the OFF state) to prevent the data signal voltage supplied through the Data line 76 and the reference voltage $V_{REF}$ of the reference voltage power supply line 68 from being applied to the node A at the same time.

Period T27: Writing Period

A period T27 between time t6 and time t7 is a writing period in which a luminance voltage corresponding to a display gradation level is supplied from the Data line 76 to the pixel circuit 60 via the switching transistor 62 and then is written into the capacitance element 67.

Specifically, at time t6, the switching transistor 62 is placed in the conducting state (the ON state) while the switching transistor 63, the switching transistor 64, and the switching transistor 65 remain in the non-conducting state (the OFF state).

With this, in addition to the actual threshold voltage $V_{th}$ of the driving transistor 61 stored in the threshold voltage compensation period, a difference in voltage between the luminance voltage and the reference voltage $V_{REF}$ of the reference voltage power supply line 68 is multiplied by (the capacitance of the light-emitting element 66)/(the capacitance of the light-emitting element 66+the capacitance of the capacitance element 67), and then held in the capacitance element 67. Since the switching transistor 65 is in the non-conducting state, the driving transistor 61 does not pass the drain current.

Thus, in the period T27 (the writing period), a voltage corresponding to the luminance voltage from the Data line 76 and the actual threshold voltage of the driving transistor 61 is held in the capacitance element 67.

Period T28

A period T28 between time t7 and time t8 is for reliably placing the switching transistor 62 in the non-conducting state.

Period T29: Light-Emitting Period

Next, a period T29 between time t8 and time t9 is a light-emitting period.

Specifically, at time t8, the switching transistor 65 is placed in the ON state while the switching transistor 62, the switching transistor 63, and the switching transistor 64 remain in the OFF state. When the switching transistor 65 is ON, a current is supplied to the light-emitting element 66 via the driving transistor 61 according to the voltage stored in the capacitance element 67, to cause the light-emitting element 66 to emit light.

Period T30

A period T30 between time t9 and t0 is for changing the potential at the node A and the node B up to a voltage close to the voltage necessary in the period T21, with all the switches placed in the non-conducting state.

The display panel 6 performs a display operation through a sequence such as that described above. As previously described, the threshold voltage compensation operation in the period T24 sometimes does not work effectively when the driving transistor 61 is of the n-channel type, and there are large variations in the threshold voltage $V_t$ between the pixel circuits (for example, the threshold voltage $V_t$ varies between about 1.5 V and 5 V). This means that: (1) the threshold voltage compensation operation may be not complete; as a result, (2) even when 0 V representing no light emission, i.e., black, is written into the capacitance element 67 as the luminance voltage, it is inevitable that the pixel circuit 60 becomes slightly luminous; and (3) the effective range of the voltage which can be held in the capacitance element 67 is narrow. These troubles can occur.

These troubles can be solved by setting the power supply voltage $V_{EL}$ of the pixel circuit 60 to neither 0 V nor a negative voltage, but to a positive voltage (e.g., 2 V to 3 V).

Therefore, the power supply unit 4 which supplies power to the plurality of pixel circuits 60 generates two different power supply voltages, the first voltage $V_{TFT}$ (e.g., more than 20 V and less than 30 V) and the second voltage $V_{EL}$ having a positive value, which is not 0 V, (e.g., 2 V to 3 V), and supplies these voltages to the pixel circuits 60. This allows effective use of the function of reducing the effect of a threshold shift of the driving transistor 61 in the threshold voltage compensation operation.

3. Advantageous Effects, Etc.

According to the display device in the present embodiment, the $V_{EL}$ power supply 420, which is the second power supply circuit that generates the second voltage, chops the first voltage $V_{TFT}$ lower than the input voltage $V_{in}$, and therefore, as compared to chopping the input voltage $V_{in}$, the switching element has a reduced transition loss, with the result that destabilization of the switching operation due to the duty cycle becoming extremely small can be avoided, allowing the second voltage to be stabilized.

The $V_{TFT}$ power supply 410, which is the first power supply circuit, and the $V_{EL}$ power supply 420, which is the second power supply circuit, both do not include transformers, and therefore can be easily made thinner and lighter.

Furthermore, the output voltage is determined according to the chopping duty cycle, and therefore it is easy to change the output voltage and fine-tune the output voltage. For example, transformer-type power supplies require a change of winding of a transformer (specifically, a change of the number of turns in the winding, a change of the turns ratio of the winding, etc.) to change the output voltage, but the above-described configuration allows the output voltage to be easily changed and fine-tuned through a change of the chopping duty cycle.

Furthermore, the second voltage $V_{EL}$ is not 0 V, but a positive value, and therefore, the threshold voltage compensation operation can function more completely.

As described above, the display device according to an aspect of the present disclosure includes: a plurality of pixel circuits that are arranged in a matrix and supplied with power through a first power supply line and a second power supply line, the first power supply line being maintained at a first voltage, the second power supply line being maintained at a second voltage having a positive value less than the first voltage; a first power supply circuit of a synchronous rectification type that outputs the first voltage to the first power supply line by chopping an input voltage; and a second power supply circuit of the synchronous rectification type that outputs the second voltage to the second power supply line by chopping the first voltage. The first power supply circuit includes: a first high-side switch and a first low-side switch connected in series between a grounding line and an input power supply line to which the input voltage is applied; a first inductor having one end connected to a connection point between the first high-side switch and the first low-side switch, and an other end connected to the first power supply line; and a first controller that controls turning ON and OFF of the first high-side switch and the first low-side switch. The second power supply circuit includes: a second high-side switch and a second low-side switch connected in series between the first power supply line and the grounding line; a second inductor having one end connected to a connection point between the second high-side switch and the second low-side switch, and an other end connected to the second power supply line; and a second controller that controls turning ON and OFF of the second high-side switch and the second low-side switch.

With this configuration, the second power supply circuit that generates the second voltage chops the first voltage lower than the input voltage $V_{in}$, and therefore, as compared to chopping the input voltage, the power supply efficiency can improve; furthermore, part of the current flowing this pixel circuit flows to the first power supply line 69 via the second power supply circuit as a regenerative circuit, and therefore the power supply efficiency can improve further.

In the second power supply circuit, the duty cycle can be kept from being extremely small, and the second voltage can be stabilized.

Furthermore, the first power supply circuit and the second power supply circuit both do not include transformers, and therefore can be easily made thinner and lighter.

Furthermore, the output voltage is determined according to the chopping duty cycle, and therefore it is easy to change the output voltage and fine-tune the output voltage. For example, transformer-type power supplies require a change of winding of a transformer (specifically, a change of the number of turns in the winding, a change of the turns ratio of the winding, etc.) to change the output voltage, but the above-described configuration allows the output voltage to be easily changed and fine-tuned through a change of the chopping duty cycle.

Here, each of the plurality of pixel circuits may include: a light-emitting element that emits light at a brightness that corresponds to an amount of current supplied to the light-emitting element; and a driving transistor that supplies the current to the light-emitting element, and the driving transistor and the light-emitting element may be connected in series between the first power supply line and the second power supply line.

Here, the display device may further include: an input capacitor connected between the input power supply line and the grounding line; a first output capacitor connected between the first power supply line and the grounding line; and a second output capacitor connected between the second power supply line and the grounding line.

With this configuration, the first output capacitor functions also as the input capacitance element of the second power supply circuit, and therefore the second power supply circuit is not required to include a separate input capacitance element, and because the first output capacitor has a reduced ripple current due to the above-described regeneration operation, a capacitor having a smaller capacitance can be used as the first output capacitor, meaning that the cost can be reduced.

Here, each of the plurality of pixel circuits includes a capacitance element connected to a gate of the driving transistor, the display device may includes a control unit configured to control a display by the plurality of pixel circuits, and the control unit may be configured to: perform a threshold voltage compensation operation on the capacitance element, the threshold voltage compensation operation being an operation of causing the capacitance element to hold a voltage equivalent to an actual threshold voltage of the driving transistor to which the capacitance element is connected; and perform a writing operation of adding a voltage representing luminance to the voltage at the capacitance element that is equivalent to the actual threshold voltage.

This configuration allows effective use of the function of reducing the effect of a threshold shift of the driving transistor in the threshold voltage compensation operation.

Variation

Figure 6:
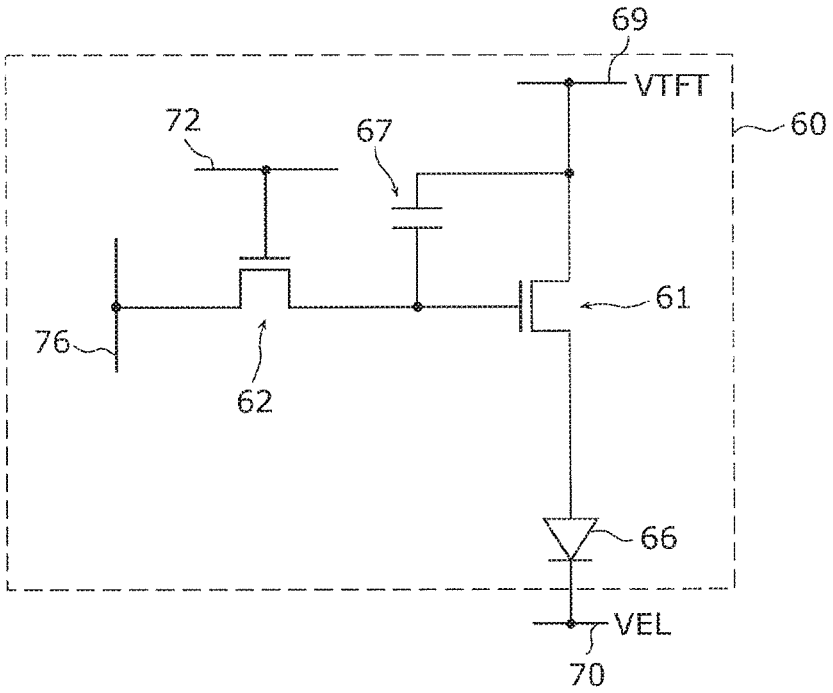
FIG. 6 is a circuit diagram illustrating a variation of a pixel circuit.

FIG. 6 is a circuit diagram illustrating an example of a configuration of the pixel circuit 60 according to a variation. The display device 1 may be configured to include the pixel circuit 60 illustrated in FIG. 6 instead of the pixel circuit 60 illustrated in FIG. 2. The pixel circuit 60 in FIG. 6 is different from that in FIG. 1 in that the switching transistor 63, the switching transistor 64, and the switching transistor 65 are not included. The pixel circuit 60 may have such a simplified configuration.

Although the display device has been described above based on embodiments, the present disclosure is not limited to these embodiments. The techniques in the present disclosure are not limited to these embodiments; appropriate modifications, interchanges, additions, omissions, etc., to the embodiments are possible. Various modifications of the present embodiments as well as embodiments resulting from arbitrary combinations of elements in different embodiments that can be conceived by those skilled in the art are intended to be included in one or more aspects as long as these do not depart from the essence of the present disclosure.

Figure 7:
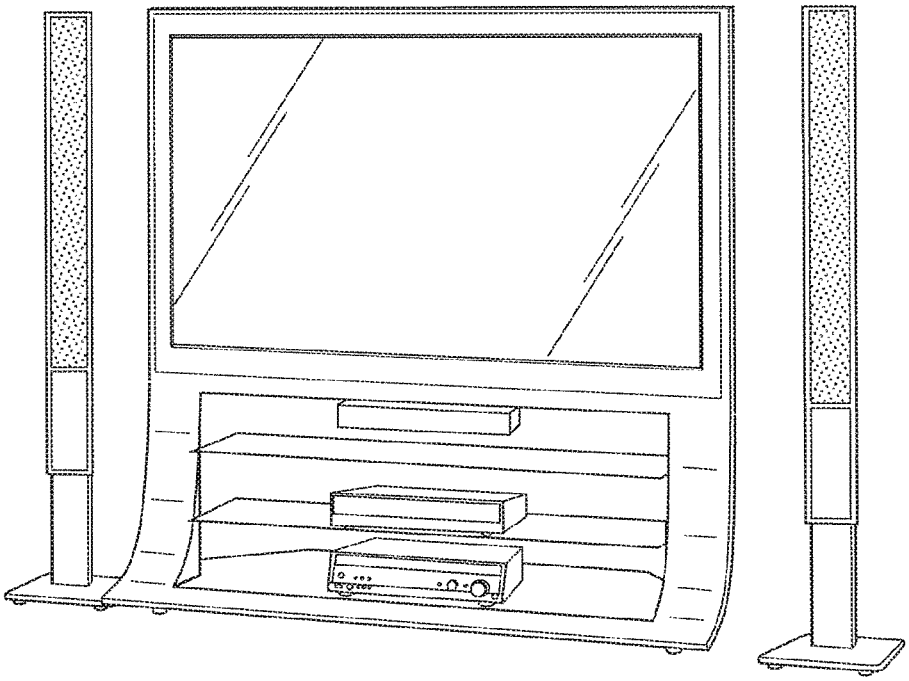
FIG. 7 illustrates an example of external appearance of a display device.

Furthermore, the above-described display device can be used, for example, as a flat panel display such as that illustrated in FIG. 7. Moreover, the above-described display device can be applied to various electronic devices including a display device, such as a television receiving set, a personal computer, and a mobile phone.

INDUSTRIAL APPLICABILITY

The present disclosure is usable as a display device such as a television receiving set and a display of an information device.

The invention claimed is:

1. A display device, comprising:

a plurality of pixel circuits that are arranged in a matrix and supplied with power through a first power supply line and a second power supply line, the first power supply line being maintained at a first voltage, the second power supply line being maintained at a second voltage having a positive value less than the first voltage;

a first power supply circuit of a synchronous rectification type that outputs the first voltage to the first power supply line by chopping an input voltage; and a second power supply circuit of the synchronous rectification type that outputs the second voltage to the second power supply line by chopping the first voltage, an input capacitor for the first power supply circuit that is connected between an input power supply line and a grounding line;

wherein the first power supply circuit includes a first high-side switch and a first low-side switch connected in series between the grounding line and the input power supply line to which the input voltage is applied;

a first inductor having one end connected to a connection point between the first high-side switch and the first low-side switch, and an other end connected to the first power supply line;

a first output capacitor connected between the first power supply line and the grounding line; and a first controller that controls turning ON and OFF of the first high-side switch and the first low-side switch, and the second power supply circuit includes a second high-side switch and a second low-side switch connected in series between the first power supply line and the grounding line;

a second inductor having one end connected to a connection point between the second high-side switch and the second low-side switch, and an other end connected to the second power supply line; and a second controller that controls turning ON and OFF of the second high-side switch and the second low-side switch, wherein the first output capacitor, which also serves as an input capacitor for the second power supply circuit, has a smaller capacitance than the input capacitor for the first power supply circuit.

2. The display device according to claim 1, wherein each of the plurality of pixel circuits includes a light-emitting element that emits light at a brightness that corresponds to an amount of current supplied to the light-emitting element; and a driving transistor that supplies the current to the light-emitting element, and the driving transistor and the light-emitting element are connected in series between the first power supply line and the second power supply line.

3. The display device according to claim 2, wherein each of the plurality of pixel circuits includes a capacitance element connected to a gate of the driving transistor, the display device includes a controller configured to control a display by the plurality of pixel circuits, and the controller is configured to perform a threshold voltage compensation operation on the capacitance element, the threshold voltage compensation operation being an operation of causing the capacitance element to hold a voltage equivalent to an actual threshold voltage of the driving transistor to which the capacitance element is connected; and perform a writing operation of adding a voltage representing luminance to the voltage at the capacitance element that is equivalent to the actual threshold voltage.

4. The display device according to claim 1, further comprising:

a second output capacitor connected between the second power supply line and the grounding line.

* * * * *